US011351431B2

(12) United States Patent
Falck

(10) Patent No.: US 11,351,431 B2
(45) Date of Patent: Jun. 7, 2022

(54) WATER FLOATABLE BAG TOSS TARGET AND SYSTEM

(71) Applicant: Brian K. Falck, Neenah, WI (US)

(72) Inventor: Brian K. Falck, Neenah, WI (US)

( * ) Notice: Subject to any disclaimer, the term of this patent is extended or adjusted under 35 U.S.C. 154(b) by 0 days.

(21) Appl. No.: 16/522,378

(22) Filed: Jul. 25, 2019

(65) Prior Publication Data

US 2021/0023428 A1 Jan. 28, 2021

(51) Int. Cl.
*A63B 67/06* (2006.01)
*A63B 67/00* (2006.01)

(52) U.S. Cl.
CPC ..... *A63B 67/06* (2013.01); *A63B 67/007* (2013.01); *A63B 2225/605* (2013.01)

(58) Field of Classification Search
CPC .. A63B 67/06; A63B 67/007; A63B 2225/605
See application file for complete search history.

(56) References Cited

U.S. PATENT DOCUMENTS

| | | | | |
|---|---|---|---|---|
| 3,403,907 | A | 10/1968 | Keller | |
| 3,652,090 | A | 3/1972 | Semmens | |
| 3,778,060 | A | 12/1973 | Lakeman | |
| 6,244,598 | B1 | 6/2001 | Conville | |
| 7,237,777 | B2 | 7/2007 | Digges, III et al. | |
| 7,607,666 | B1 | 10/2009 | Studier | |
| 2005/0023762 | A1 | 2/2005 | Greiwe et al. | |
| 2006/0125186 | A1* | 6/2006 | Digges, III | A63B 67/06 273/402 |
| 2006/0247072 | A1* | 11/2006 | Combs | A63B 63/00 473/348 |
| 2013/0082442 | A1 | 4/2013 | Hanel | |
| 2014/0183822 | A1 | 7/2014 | Ethridge | |
| 2014/0227921 | A1* | 8/2014 | DeBruyn | B63B 32/10 441/79 |
| 2015/0108719 | A1* | 4/2015 | Devine | A63B 67/06 273/402 |
| 2017/0056739 | A1 | 3/2017 | Jacobson et al. | |
| 2018/0043227 | A1 | 2/2018 | Segerstrom | |

* cited by examiner

*Primary Examiner* — Jeffrey S Vanderveen
(74) *Attorney, Agent, or Firm* — Davis & Kuelthau, s.c.

(57) ABSTRACT

A water floatable bag toss target, the target including a landing surface disposed overlying a bottom surface by a left side, a right side, a front end and a back end each joined to the landing surface and bottom surface. The landing surface is positively sloped along its surface when moving from the front end toward the back end and the bottom surface is oriented horizontally. A scoring hole is in the landing surface and communicating with a scoring box compartment located between the landing surface and the bottom surface. The scoring box compartment has compartment walls extending between the landing surface and the bottom surface and dividing an inside of the target into an internal hollow compartment and the scoring box compartment. The internal hollow compartment is water-tight relative to the scoring box compartment and relative to an outside of the target.

23 Claims, 5 Drawing Sheets

WATER FLOATABLE BAG TOSS TARGET AND SYSTEM

TECHNICAL FIELD

This invention relates to bag toss targets for use in bag toss games, and more particularly, to a water floatable bag toss target and system for playing bag toss games in the water.

BACKGROUND

Bag toss games have been played in the United States for many years. In most bag toss games, players take alternating turns attempting to toss a plurality of sealed bags (typically four bags for each player) containing particulate matter (e.g., dried corn, beans, rice, sand, plastic beads, etc.), one at a time, through an opening or hole in a fixed target assembly that is resting on the ground a predetermined distance away from the player. Typically, two spaced apart target assemblies are used, and each features a deck that is angled slightly toward the player with respect to the ground on which the target assembly is resting. The ideal fixed target assembly would be a cement formed target (of the size and configuration prescribed below by the ACA) that does not move or flex when impacted by the tossed bags. Obviously, such a structure is not easily portable, and thus other portable structures have been developed to have both portability and be as fixed as possible during game play.

Bag toss games can be played using a variety of rules. Most rules award players a plurality of points for every bag that is tossed or knocked entirely through the hole in the deck of the target assembly, a lesser amount of points for bags that remain on the deck but do not pass entirely through the hole in the deck, and no points for bags that do not pass through the hole in the deck or remain on the deck after all of the bags have been tossed. Games are usually played until one of the players or a team of two players accumulates sufficient points to reach a predetermined goal.

Traditional bag toss game target assemblies constitute unitary, rigid structures constructed from ½" to ¾" plywood. A bag toss game that is popular in the United States is known as "Cornhole" or "Corn Toss" features target assemblies constructed of painted plywood that consist of a deck that is permanently attached to wooden support structure such as plywood or 2"×4" studs. An organization known as the American Cornhole Association ("ACA") has adopted standards that specify that the target assemblies (which are sometimes referred to as "platforms") used in that particular bag toss game should have a flat deck that is 24" wide, 48" long and have a single 6" circular hole or opening through the deck centered between the sides of the deck approximately 9" from a raised rear portion of the deck. Due to the dimensions and the materials used, while portable, bag toss game target assemblies of this type still tend to be rather heavy, which makes them difficult to transport, store, expensive to ship and not good for use in the water.

In recent years, at least one bag toss game target assembly has been taught for use in the water. However, making a bag toss game target simulate the ideal fixed target assembly used on the ground, but the target being for use in the water, has not been possible.

SUMMARY

After much trial, error and experimentation, the inventor has surprisingly discovered and invented the subject water floatable bag toss target which meets the requirements of the ideal fixed target assembly like used on the ground, but instead being great for use in the water, and which water may be moving or still. The invention is a new water floatable bag toss target. The target includes a landing surface disposed overlying a bottom surface by a left side, a right side, a front end and a back end each joined to the landing surface and bottom surface. Each of the left side, right side, front end and back end is configured to cause the landing surface to be positively sloped along its surface when moving from the front end toward the back end and the bottom surface is oriented horizontally. A scoring hole is located in the landing surface and communicating with a scoring box compartment located between the landing surface and the bottom surface, the scoring hole located closer to the back end than the front end. The scoring box compartment has compartment walls extending between the landing surface and the bottom surface and dividing an inside of the target into an internal hollow compartment and the scoring box. The internal hollow compartment is watertight relative to the scoring box compartment and relative to an outside of the target.

Other features concern the scoring box compartment and how it is configured to receive Regulation Sized game bags, as well as its being a single space compartment. Somewhat related to this, are configuration features of the internal hollow compartment. For example, it may be a substantially continuous space, a substantially single and continuous space, having at least three times a volume of hollow compartment space as compared to a volume of scoring box compartment space, or being substantially void of solid structure and can only accommodate a gas.

Still other features are directed to the internal skeleton, which can be joined to at least the landing surface, the bottom surface, the left side, the right side, the front end or the back end. The internal skeleton is preferably joined to each of the landing surface, the bottom surface, the left side, the right side, the front end and the back end, and it may be a network of dowels.

Additional features are related to how the target floats in water, and preferably to best simulate on land play but be for in water game play. As such, the target bottom surface is preferably substantially horizontal both before and during game play. For example, this can be achieved more consistently when the target has a particular Flotation Factor, Buoyancy Force to Mass ratio, or Bounce Factor, all as described further below.

In other embodiments there is a system, including a pair of said water floatable bag toss targets, each of the targets having at least one anchor cleat attached to each corner of the target and each anchor cleat adapted to receive an anchor line, and the relative positioning of the boards from each other for game play.

In some embodiments the game bag is made of a blended fabric material, and its particular blending can be important because of game play in water and on a target likely to and able to get wet during game play.

BRIEF DESCRIPTION OF THE DRAWINGS

The invention may be more completely understood in consideration of the following detailed description of various embodiments of the invention in connection with the accompanying drawings, in which.

Figure 1:
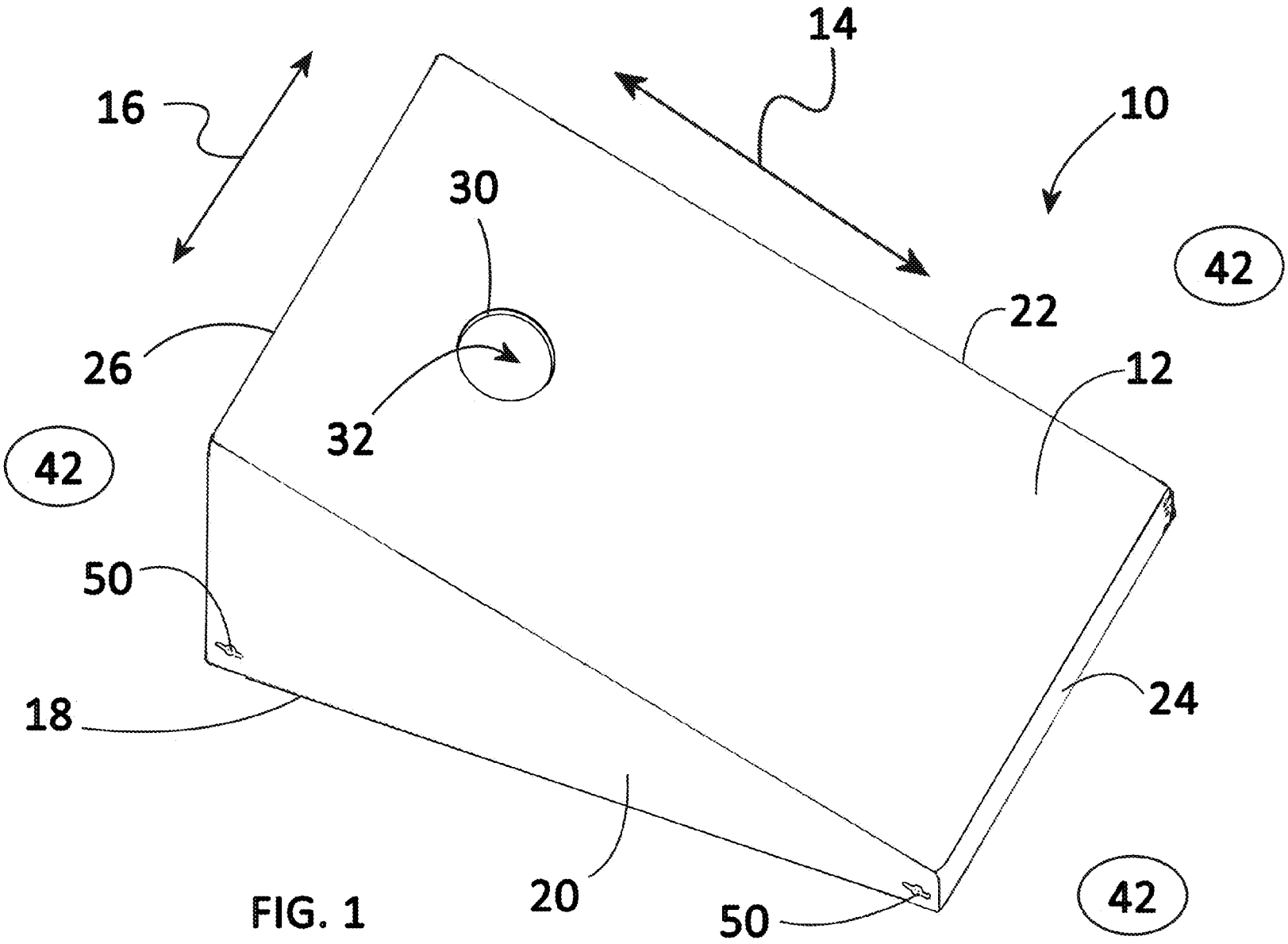
FIG. 1 is a perspective top view of the water floatable bag toss target of the invention.

The drawings show some but not all embodiments. The elements depicted in the drawings are illustrative and not necessarily to scale, and the same (or similar) reference numbers denote the same (or similar) features throughout the drawings.

DETAILED DESCRIPTION

In accordance with the practice of at least one embodiment of the invention, as seen in the Figures, a water floatable bag toss target 10 includes a landing surface 12 disposed overlying a bottom surface 18. A left side 20, a right side 22, a front end 24 and a back end 26 each are joined to, and thereby join together, the landing surface 12 with the bottom surface 18. As used herein, "join" or its formatives means that the stated components or parts are attached to each other, directly or indirectly, and would require a force to separate them. Each of the left side, right side, front end and back end is also configured to cause the landing surface 12 to be positively sloped along its surface when moving from the front end 24 toward the back end 26 and the bottom surface is oriented horizontally (e.g., floating on water). The landing surface and the bottom surface may be, and preferably are, each rectangular in shape, e.g., when playing the Cornhole game. Further in this regard, the rectangular shape may be about twice as long in a length dimension 14 as in a width dimension 16. Still further, the length dimension may preferably be about four feet long.

Figure 3:
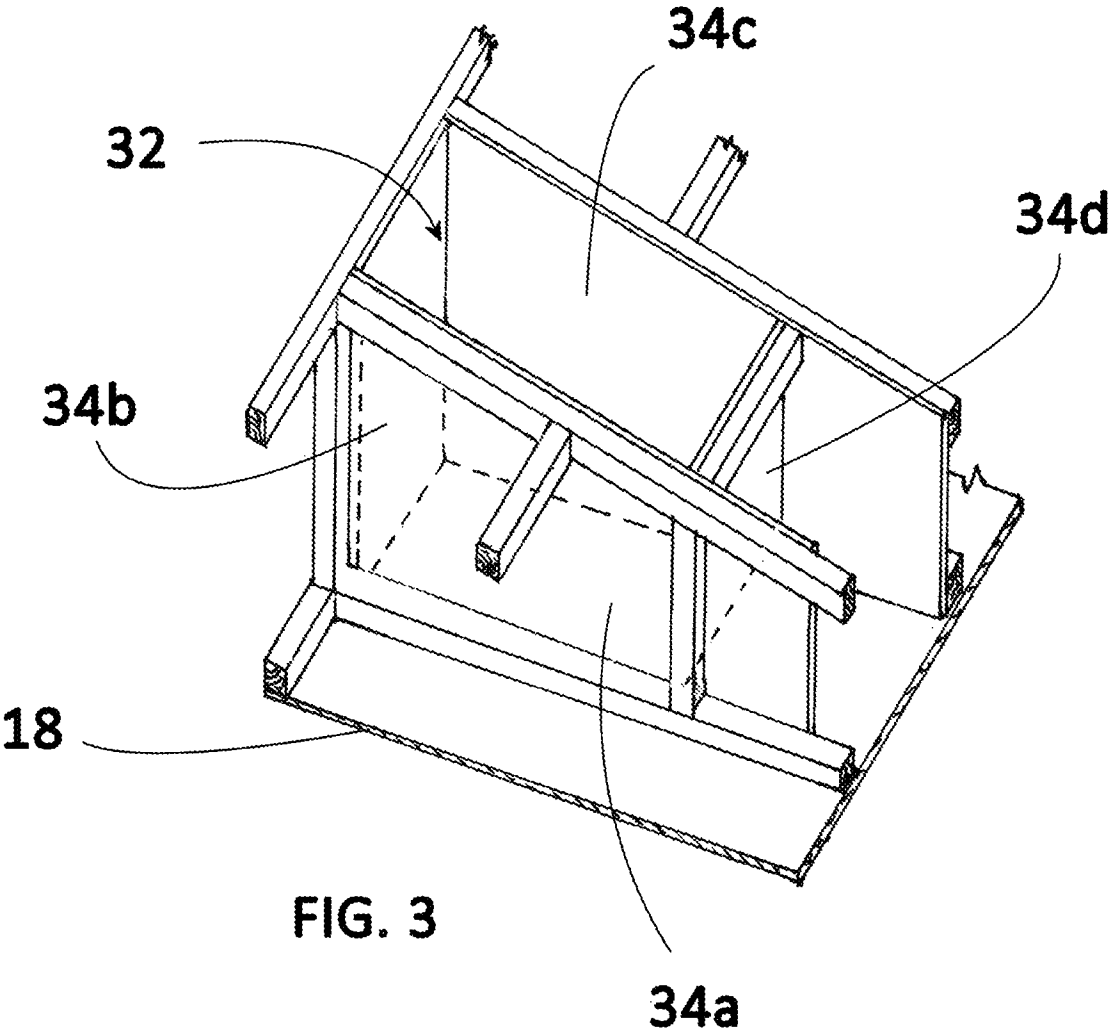
FIG. 3 is a perspective cut-away view of a partial section of the water floatable bag toss target and the internal skeleton featuring the scoring box compartment.

A scoring hole 30 is located in the landing surface and communicates with a scoring box compartment 32 located between the landing surface and the bottom surface. The scoring hole 30 is located closer to the back end 26 than the front end 24. The scoring box compartment has compartment walls 34 (e.g., 34*a*, 34*b*, 34*c* and 34*d* in FIG. 3) extending between the landing surface and the bottom surface and dividing an inside of the target into an internal hollow compartment 40 and the scoring box compartment 32. The internal hollow compartment 40 is water-tight relative to the scoring box compartment 32 and relative to an outside 42 of the target 10. As used herein, "inside" means all the area and space contained by the two surfaces 12, 18 and the two sides 20, 22 and the two ends 24, 26. And, as used herein, "outside" means all the area and space that is not inside the target.

The water-tight feature relative to outside of the target 10, for example, can be achieved by water-tight seals formed at the joints where left side 20, right side 22, front end 24 and back end 26 each are joined to, and thereby join together, the landing surface 12 with the bottom surface 18. And, the water-tight feature of the internal hollow compartment 40 relative to the scoring box compartment 32, for example, can be achieved by water-tight seals formed at the joints where scoring box compartment walls 34 (e.g., 34*a*, 34*b*, 34*c* and 34*d* in FIG. 3) join each other and where they join the landing surface 12 and the bottom surface 18. Without being limited to a particular theory of understanding, these water-tight seals, and more so the related sealed compartments 32 and 40, provide the inventive target with its desired buoyancy in a durable structure that floats on water, and preferably, in a light weight structure too. And, with the scoring box compartment being sealed form the internal hollow compartment, any water getting inside the scoring box compartment from a few drops to completely filling the scoring box, cannot get into the hollow compartment and disrupt the buoyancy of the target. And, the scoring box also provides a contained space for the tossed bags so they are easy to retrieve after each round of play.

Other features the invention may include are related to the compartments 32 or 40. These aid in tailoring the buoyancy characteristics of the target or the rigidity/bounce characteristics of the landing surface. For example, the scoring box compartment can be, and preferably is, a single space compartment, as seen in all the Figures. The internal hollow compartment 40 may be a substantially continuous space, as seen in the Figures, or it could be two or more sub-spaces (not shown). Further, preferably, the internal hollow compartment can be a substantially single and continuous space. Still further, and even more preferably, the internal hollow compartment is substantially void of solid structure and can only accommodate a gas. That is, other than the walls and any joined structure to the walls of the compartments, there is not solid structure between the walls throughout the compartments, e.g., no foam or foam like structure that captures gas. Rather, there is substantially only gas (e.g. air) itself in the compartments. Yet further, the internal hollow compartment may have at least three times a volume of hollow compartment space as compared to a volume of scoring box compartment space, and thus have three times the volume of gas (e.g. air) in the relative compartments. This can aid in the buoyance features, as also in maintaining the horizontal orientation of the target when floating in water. For example, it is preferable that the target bottom surface be substantially horizontal both before and during game play, and the buoyancy features individually and in combination can contribute to this in the invention unlike ever before.

In other aspects of the invention related to the desired buoyance of the inventive target when floating in water to simulate the ideal fixed target assembly like one resting on the ground, the water floatable bag toss target preferably has a Flotation Factor, which is a ratio between the weight of displaced water to the actual weight of the target 10. The water floatable bag toss target preferably has a Flotation Factor between 1.5 (weight of target to weight of water displaced) and 1.15 (weight of target to weight of water displaced). More preferably, the target 10 has a Flotation Factor between 1.3 and 1.25. For example, a target displaces 14.6 pints of water (having water weight of 14.95 pounds), and the target weighs 19 pounds. This will give a Flotation Factor of 1.27.

Yet further, preferred, aspects related to buoyance concern the water floatable bag toss target having a Buoyancy Force to Mass (actual weight of the target ratio) ratio between about 2.75 N/Lb and about 3.75 N/Lb, in units of newtons per pound. More preferably, the target has a Buoyancy Force to Mass ratio between 3.25 N/Lb and 3.5 N/Lb. The Buoyancy Force is determined by the following formula: B=PfVg, where B=buoyant force in N (newtons), Pf=fluid density in $kg/m^3$, V=displaced body volume of liquid in $kg/m^3$, and g=9.806 $m/s^2$ (standard gravity). It may also be helpful to use this calculator: http://www.omnicalculator-.com/physics/buoyancy#what-is-the-buoyant-force. For example, a target may have a Buoyancy Force of 66.5 N and a Mass of 19 pounds. Then the Buoyancy Force to Mass ratio is 3.5 N/Lb.

Another aspect of the invention concerns construction particulars of the target, and achieving the right balance of weight and flotation (e.g., the Buoyancy Force to Mass ratio), while still achieving a durable overall structure to closely simulate the ideal fixed target assembly but in the inventive water floatable bag toss target. In reference to FIGS. 2 and 3, for example, such a durable and light target structure may be achieved by an internal skeleton 44 joined to at least one of the landing surface, the bottom surface, the left side, the right side, the front end or the back end. More preferably, this can be the internal skeleton 44 joined to each of the landing surface, the bottom surface, the left side, the right side, the front end and the back end. Still more preferably, the internal skeleton includes a network of dowels, and namely, square dowels to simplify construction of joining parts together.

As further relates to durability of the target 10 and its simulation of the ideal fixed target assembly in the form of the invention used in water, the landing surface can have a Bounce Factor less than one $32^{nd}$ of an inch. That is, preferably the surface elasticity and state that the landing surface has, especially the lower area below the scoring hole, deforms less than one $32^{nd}$ of an inch when a force of three pounds per square inch is applied by a one inch cylindrical dowel with a flat round end anywhere to the landing surface. For example, three pounds per square inch is chosen as it approximately replicates the force of a one pound game bag hitting a target when thrown from approximately 25 feet away.

Figure 5:
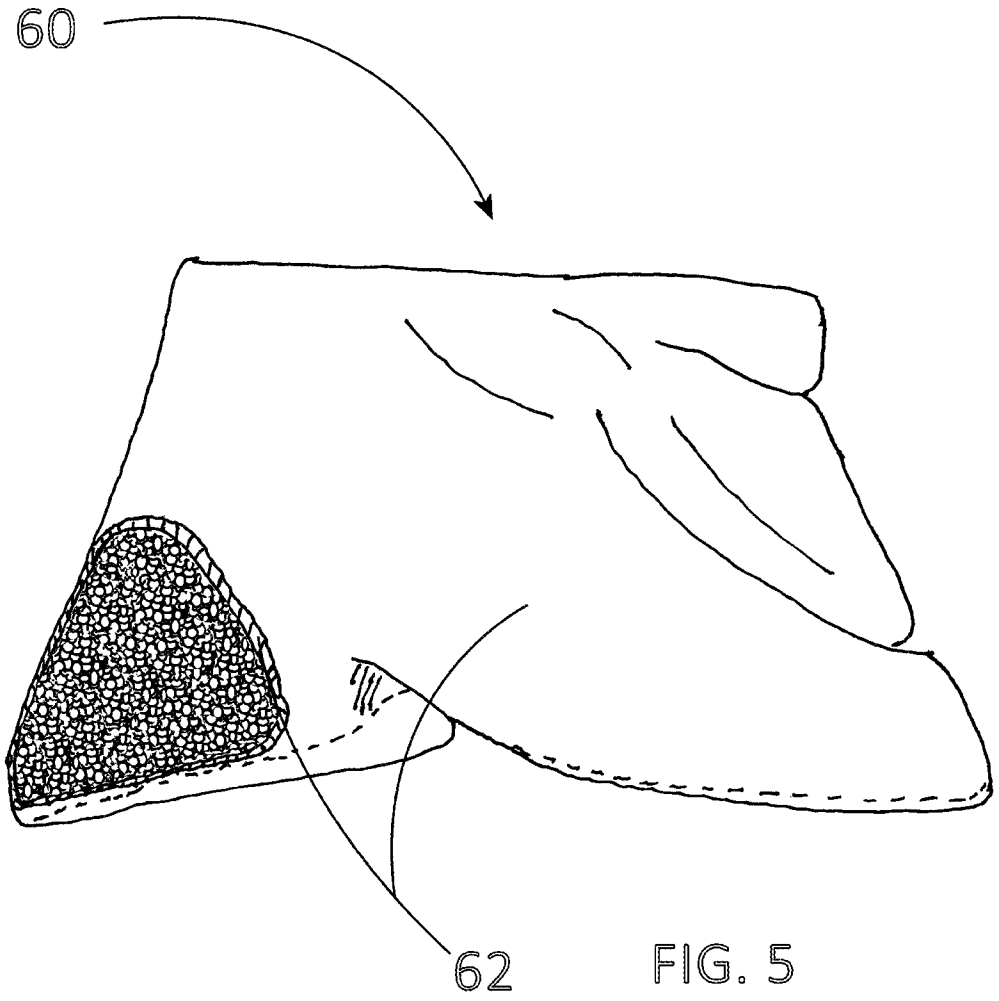

In other aspects of the invention, the scoring box compartment can be configured to receive eight Regulation Sized game bags, one of which is seen in FIG. 5. That is, all eight game bags will fit into the scoring box compartment (some manipulation may be needed but not excessive force to get them to fit into the compartment) and no bag will protrude out of the scoring hole above the outer surface of the landing surface. As used herein, a "Regulation Sized" game bag 60 measures about six inches by six inches, has two sides joined around their edges to form a hollow center that holds enough pellet or bead like items to make the bag and its center items weigh about one pound. Bags of, and used with, the invention will have some type of hydrophobic center items, for example plastic pellets. Preferably, the game bag of the invention may be made of a blended fabric material 62. More preferably, the blended fabric material may comprise 20% to 50% of cotton with 80% to 50% of polyester. This fabric material will be substantially homogenous, so cotton and polyester fibers/threads are rather even mixed together throughout the fabric material. Still more preferably, the blended material may be 30% to 40% of cotton with 70% to 60% of polyester. Most preferably, the blended material may be about 35% cotton and 65% polyester. An example of this material can be that called SEW Classics™ Bottomweight Canvas target solid fabric sold by the roll at Joann Fabric®.

Figure 4:
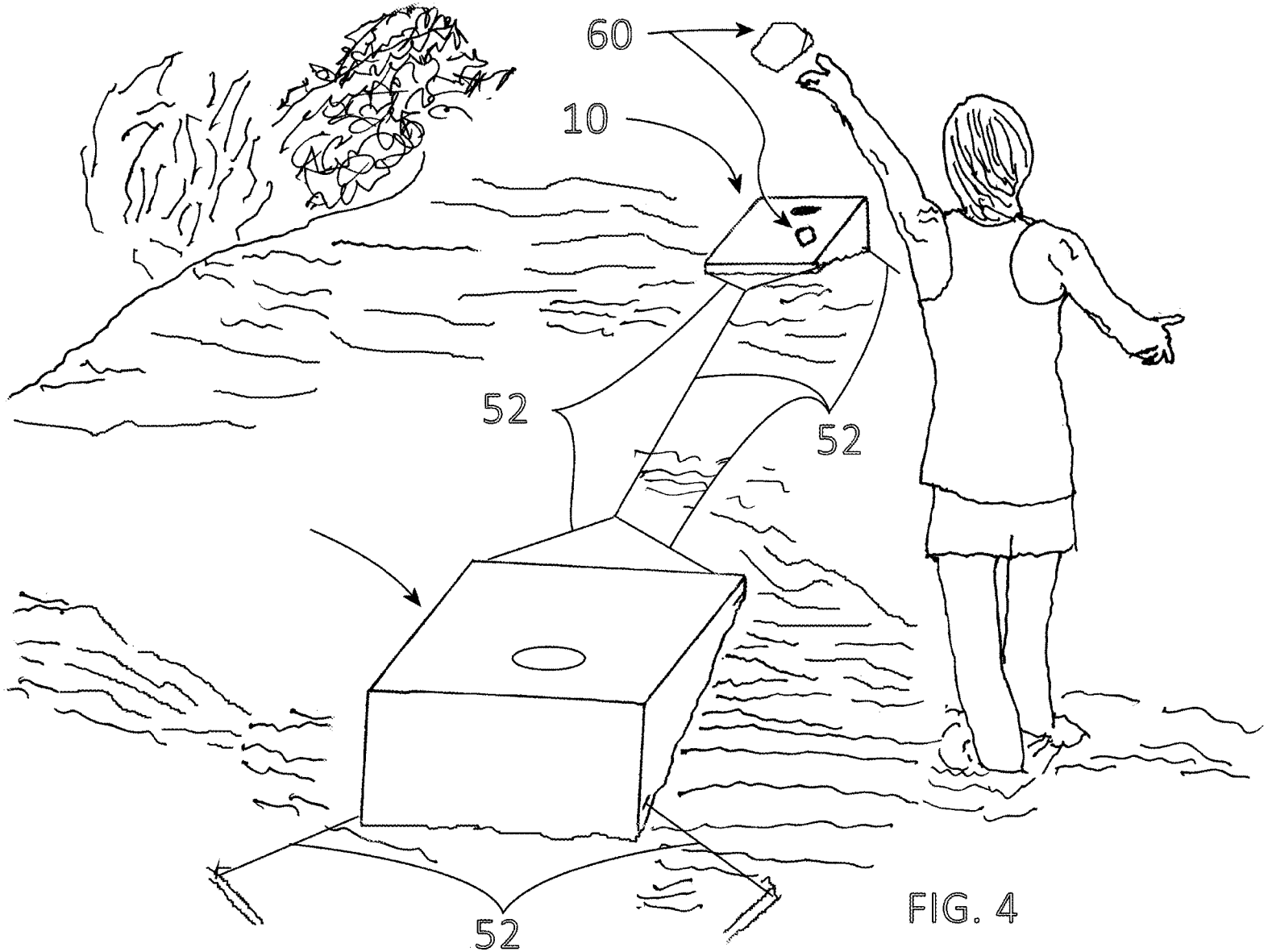
FIG. 4 is a perspective view of targets of the invention being used for game play; and, FIG. 5 is a partial cut-away perspective view of a game bag of this invention.

In still other aspects of the invention, and as seen in FIG. 4, a system is provided including a pair of said water floatable bag toss targets 10. And, preferably, each of the targets has at least one anchor cleat 50 attached to each corner of the target and each anchor cleat is adapted to receive an anchor line 52. More preferably, the pair of targets can be anchored together at their front ends via a first anchor line and each target can be anchored to a different remote surface at each target's back end via a second anchor line. In this way, the targets can be substantially maintained a set distance apart from each other when floating on water, especially if the water is moving.

Figure 2:
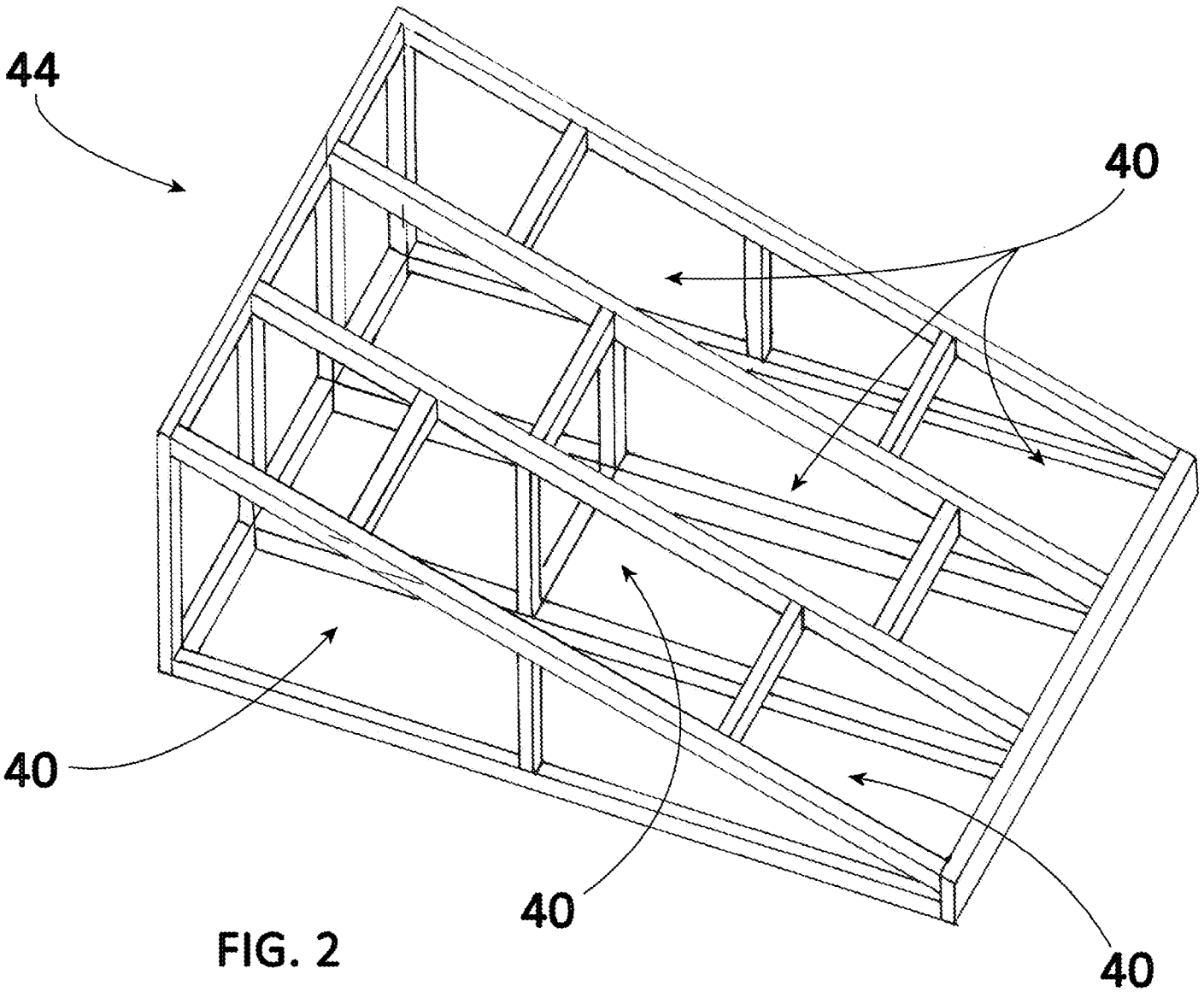
FIG. 2 is a perspective view of the internal skeleton of the invention.

One example of how to make target 10 of the invention is now described. Manufacture can begin with using waterproof adhesive to join lightweight wooden pieces together to form internal skeleton 44 as depicted in FIG. 2. The integral scoring box compartment 32 depicted in FIG. 3 can be attached to the internal skeleton to form compartment 40, preferably large enough to hold all eight game bags 60 in a conventional game, without obstructing the scoring hole 30 outside of the target. The outside surfaces and sides of target 10 and compartment walls 34 of the scoring box compartment 32 can be cut from a light weight thin wooden plywood product, such as Luan.

After the internal skeleton has been assembled along with the internal walls of the scoring box compartment, the bottom surface 18 of wood skin can be attached to the skeleton using waterproof adhesive and small brads. Before attaching the rest of the external wood skin for sides, ends and landing surface, it is important to seal the seams of the scoring box compartment and waterproof it. This can be accomplished by running a concave bead of boatbuilding epoxy mixed with a lightweight additive creating a fillet on each of the internal corners of the scoring box compartment. Specifically, a fillet can be created on each of the four seams running around the perimeter of the bottom of the scoring box as well as the four seams in the corners of the box running from the bottom surface to the landing surface. After the fillet epoxy has dried two more coats of boatbuilding epoxy can be applied to the interior of the scoring box compartment and the internal portion of the landing surface top external skin piece which will be exposed as the scoring hole communicating with the scoring box compartment. These additional coats help assure that the scoring box compartment is entirely waterproof and water will be incapable of seeping into the sealed portion of the target internal hollow compartment as well.

The next step is to attach two side and two end wood skin pieces as well as the landing surface wood skin piece to the internal skeleton using a waterproof adhesive. The section of the top landing surface wood skin which was sealed with boatbuilders epoxy should be aligned with the scoring box compartment to ensure the scoring box is watertight. The landing and bottom surface, and front and back ends, should be cut large enough to overlap the left and right side wood skins. This allows for a better seal of the external structure in the final steps of manufacture. After drying the scoring hole is cut in the top surface wood skin equal distance from both sides and relative to the back end of the target for desired scoring hole placement.

The entire floating scoring board is then sanded. The same boatbuilding epoxy mixture used to create the fillets in the scoring box compartment can then be used to fill any gaps or nail (e.g., the brads) holes on the exterior of the target. After drying the target is once again sanded smooth, repeating the prior process in order to fill in any gaps or nail holes that may have been missed. The bottom and sides of the target are then coated with a layer of boatbuilders epoxy. Woven fiberglass cloth can then be applied to the wet epoxy. Additional boatbuilders epoxy can then be applied to the fiberglass "wetting" the fiberglass out. A plastic scraper can be used to help ensure there are no air bubbles under the fiberglass and that the fiberglass is lying flat to the wooden skin. After drying, additional coats of boatbuilders epoxy can be applied to the top surface of the target in addition to those covered with fiberglass ensuring a waterproof and watertight target. Before painting the target outer surface can be again sanded with fine grit sandpaper, followed by two coats of durable oil-based acrylic paint. The edge of the scoring hole can be painted in a contrasting color in order to assure visibility. A final layer to assure durability is to apply three coats of a durable automotive clearcoat. After the finish has cured anchor cleats 50 can be attached to the four outside corners of the target at water level as seen in FIG. 1.

The target could also be created utilizing another boat-building process for lightweight watercraft. This process is called roto-molding which uses centrifugal force to push molten plastic against the walls inside of a mold. This process would likely may be most useful in the mass production of the invention.

To make the game bags of the invention, which are preferably waterproof bags, rectangles of the prior described polyester/cotton blend fabric are sewn together to make squares which can then be filled with polypropylene beads and stitched closed. Two different colors can be used to make the bags which are clearly distinguishable from one another.

Each and every document cited in this present application, including any cross referenced or related patent or application, is incorporated in this present application in its entirety by this reference, unless expressly excluded or otherwise limited. The citation of any document is not an admission that it is prior art with respect to any embodiment disclosed in this present application or that it alone, or in any combination with any other reference or references, teaches, suggests, or discloses any such embodiment. Further, to the extent that any meaning or definition of a term in this present application conflicts with any meaning or definition of the same term in a document incorporated by reference, the meaning or definition assigned to that term in this present application governs.

The present invention includes the description, examples, embodiments, and drawings disclosed; but it is not limited to such description, examples, embodiments, or drawings. As briefly described above, the reader should assume that features of one disclosed embodiment can also be applied to all other disclosed embodiments, unless expressly indicated to the contrary. Unless expressly indicated to the contrary, the numerical parameters set forth in the present application are approximations that can vary depending on the desired properties sought to be obtained by a person of ordinary skill in the art without undue experimentation using the teachings disclosed in the present application. Modifications and other embodiments will be apparent to a person of ordinary skill in the packaging arts, and all such modifications and other embodiments are intended and deemed to be within the scope of the present invention.

What is claimed is:

1. A water floatable bag toss target comprising:

a landing surface disposed overlying a bottom surface by a left side, a right side, a front end and a back end each joined to the landing surface and bottom surface;

each of the left side, right side, front end and back end configured to cause the landing surface to be positively sloped along its surface when moving from the front end toward the back end and the bottom surface is oriented horizontally;

a scoring hole located in the landing surface and communicating with a scoring box compartment located between the landing surface and the bottom surface, the scoring hole located closer to the back end than the front end, and wherein the landing surface and the bottom surface are each rectangular in shape; and, the scoring box compartment having compartment walls extending between the landing surface and the bottom surface and dividing an inside of the target into an internal hollow compartment and the scoring box compartment, wherein the internal hollow compartment is water-tight relative to the scoring box compartment and relative to an outside of the target.

2. The water floatable bag toss target of claim 1 wherein the scoring box compartment is configured to receive eight Regulation Sized game bags.

3. The water floatable bag toss target of claim 1 wherein the scoring box compartment is a single space compartment.

4. The water floatable bag toss target of claim 1 wherein the internal hollow compartment is a substantially continuous space.

5. The water floatable bag toss target of claim 1 wherein the internal hollow compartment is a substantially single and continuous space.

6. The water floatable bag toss target of claim 1 wherein the internal hollow compartment has at least three times a volume of hollow compartment space as compared to a volume of scoring box compartment space.

7. The water floatable bag toss target of claim 1 wherein the internal hollow compartment is substantially void of solid structure and can only accommodate a gas.

8. The water floatable bag toss target of claim 1 further comprising an internal skeleton joined to at least of the landing surface, the bottom surface, the left side, the right side, the front end or the back end.

9. The water floatable bag toss target of claim 8 wherein the internal skeleton is joined to each of the landing surface, the bottom surface, the left side, the right side, the front end and the back end.

10. The water floatable bag toss target of claim 9 wherein the internal skeleton comprises a network of dowels.

11. The water floatable bag toss target of claim 1 further comprising at least one anchor cleat attached to the target and adapted to receive an anchor line.

12. The water floatable bag toss target of claim 1 further wherein when the target floats in water the target bottom surface is substantially horizontal both before and during game play.

13. The water floatable bag toss target of claim 1 further comprising the target having a Flotation Factor between 1.5 and 1.15 when floating in water.

14. The water floatable bag toss target of claim 1 further comprising the target having a Buoyancy Force to Mass ratio between about 2.75 N/Lb and about 3.75 N/Lb.

15. The water floatable bag toss target of claim 1 wherein the landing surface has a Bounce Factor less than one $32^{nd}$ of an inch.

16. The water floatable bag toss target of claim 1 wherein the rectangular shape is about twice as long in a length dimension as in a width dimension.

17. The water floatable bag toss target of claim 16 wherein the length dimension is about four feet long.

18. The water floatable bag toss target of claim 1 comprising a system including a pair of said water floatable bag toss targets, each of the targets having at least one anchor cleat attached to each corner of the target and each anchor cleat adapted to receive an anchor line.

19. The water floatable bag toss target of claim 18 comprising the pair of targets anchored together at their front ends via a first the anchor line and each target anchored to a different remote surface at each target's back end via a second anchor line, such that the targets can be substantially maintained a set distance apart from each other when floating on water.

20. The water floatable bag toss target of claim 1 further comprising a game bag made of a blended fabric material and wherein the blended material comprises 20% to 50% of cotton with 80% to 50% of polyester.

21. The water floatable bag toss target of claim 20 wherein the blended material comprises 30% to 40% of cotton with 70% to 60% of polyester.

22. A water floatable bag toss target comprising:

a landing surface disposed overlying a bottom surface by a left side, a right side, a front end and a back end each joined to the landing surface and bottom surface;

each of the left side, right side, front end and back end configured to cause the landing surface to be positively sloped along its surface when moving from the front end toward the back end and the bottom surface is oriented horizontally;

a scoring hole located in the landing surface and communicating with a scoring box compartment located between the landing surface and the bottom surface, the scoring hole located closer to the back end than the front end;

the scoring box compartment having compartment walls extending between the landing surface and the bottom surface and dividing an inside of the target into an internal hollow compartment and the scoring box compartment, wherein the internal hollow compartment is water-tight relative to the scoring box compartment and relative to an outside of the target; and, the target having a Flotation Factor between 1.5 and 1.15 when floating in water.

23. A water floatable bag toss target comprising:

a landing surface disposed overlying a bottom surface by a left side, a right side, a front end and a back end each joined to the landing surface and bottom surface;

each of the left side, right side, front end and back end configured to cause the landing surface to be positively sloped along its surface when moving from the front end toward the back end and the bottom surface is oriented horizontally;

a scoring hole located in the landing surface and communicating with a scoring box compartment located between the landing surface and the bottom surface, the scoring hole located closer to the back end than the front end;

the scoring box compartment having compartment walls extending between the landing surface and the bottom surface and dividing an inside of the target into an internal hollow compartment and the scoring box compartment, wherein the internal hollow compartment is water-tight relative to the scoring box compartment and relative to an outside of the target; and, the target having a Buoyancy Force to Mass ratio between about 2.75 N/Lb and about 3.75 N/Lb.

* * * * *